US008851591B2

(12) United States Patent
Meier et al.

(10) Patent No.: US 8,851,591 B2
(45) Date of Patent: Oct. 7, 2014

(54) FASTENING ARRANGEMENT

(75) Inventors: Eckhard Meier, Bünde (DE); Daniel Rehage, Bielefeld (DE); Daniel Reidt, Herford (DE)

(73) Assignee: Paul Hettich GmbH & Co. KG., Kirchlengern (DE)

( * ) Notice: Subject to any disclaimer, the term of this patent is extended or adjusted under 35 U.S.C. 154(b) by 199 days.

(21) Appl. No.: 13/254,485

(22) PCT Filed: Mar. 3, 2010

(86) PCT No.: PCT/EP2010/052694

§ 371 (c)(1),
(2), (4) Date: Nov. 15, 2011

(87) PCT Pub. No.: WO2010/100190

PCT Pub. Date: Sep. 10, 2010

(65) Prior Publication Data

US 2012/0063708 A1 Mar. 15, 2012

(30) Foreign Application Priority Data

Mar. 6, 2009 (DE) ..... 20 2009 003 047 U

(51) Int. Cl.

| | |
|---|---|
| ***A47B 81/00*** | (2006.01) |
| ***A47B 77/08*** | (2006.01) |
| ***A47B 88/14*** | (2006.01) |
| ***A47B 88/04*** | (2006.01) |
| ***F24C 15/16*** | (2006.01) |

(52) U.S. Cl.

CPC ..... *F24C 15/168* (2013.01); *A47B 88/14* (2013.01); *A47B 88/044* (2013.01)

USPC ..... 312/410; 312/228.1; 126/339

(58) Field of Classification Search

CPC ..... F24C 15/168; F24C 15/16

USPC ..... 312/408, 410, 228.1, 311, 334.1, 334.6, 312/334.27, 334.32; 126/337 R, 339, 332, 126/340, 333

See application file for complete search history.

(56) References Cited

U.S. PATENT DOCUMENTS 1,341,829 A * 6/1920 Whittinghill ..... 126/339
1,869,899 A * 8/1932 Kuckel ..... 126/339

(Continued)

FOREIGN PATENT DOCUMENTS

DE 10102589 A1 * 8/2002 ..... F24C 15/16
DE 20 2004 005 475 8/2004

(Continued)

OTHER PUBLICATIONS

Machine Translation of DE 10102589 (Beck et al.), 5pgs., originally published Aug. 2002.*

*Primary Examiner* — Daniel Rohrhoff
*Assistant Examiner* — Kimberley S Wright
(74) *Attorney, Agent, or Firm* — Barnes & Thornburg LLP

(57) ABSTRACT

A fastening arrangement for fixing a guide rail of a pull-out guide to a side grid of an oven. The side grid includes a rod having end sections bent at an angle and each end section is fixed to a post of the side grid and the guide rail being fixed to the rod. The fastening arrangement includes fastening means for fixing the guide rail to the rod and the fastening means is formed integrally with the guide rail.

7 Claims, 20 Drawing Sheets

(56) References Cited

U.S. PATENT DOCUMENTS

| | | | | |
|---|---|---|---|---|
| 2,099,653 | A * | 11/1937 | Kneisley | 108/137 |
| 2,113,544 | A * | 4/1938 | Haley | 312/400 |
| 5,407,084 | A | 4/1995 | Remmers | |
| 5,411,333 | A * | 5/1995 | Hoffman | 384/18 |
| 6,491,173 | B1 * | 12/2002 | Costa | 211/126.15 |
| 6,643,900 | B2 * | 11/2003 | Jahrling | 24/563 |
| 7,448,508 | B2 * | 11/2008 | Babucke et al. | 211/126.9 |
| 8,047,199 | B2 * | 11/2011 | Le et al. | 126/339 |
| 8,162,560 | B2 * | 4/2012 | Wittgrebe | 403/397 |
| 8,573,720 | B2 * | 11/2013 | Wittgrebe | 312/410 |
| 2001/0044992 | A1 * | 11/2001 | Jahrling | 24/563 |
| 2005/0174022 | A1 * | 8/2005 | Kuttalek | 312/410 |
| 2005/0217501 | A1 * | 10/2005 | Babucke et al. | 99/450 |
| 2006/0065265 | A1 * | 3/2006 | Erdmann et al. | 126/339 |
| 2007/0284982 | A1 * | 12/2007 | Brexler et al. | 312/334.38 |
| 2009/0016812 | A1 * | 1/2009 | Wittgrebe | 403/189 |
| 2009/0095279 | A1 * | 4/2009 | Ambrose et al. | 126/337 R |
| 2009/0127217 | A1 * | 5/2009 | Wittgrebe | 211/162 |
| 2010/0218755 | A1 * | 9/2010 | Stewart et al. | 126/339 |
| 2011/0113597 | A1 * | 5/2011 | Budde | 24/457 |
| 2011/0123260 | A1 * | 5/2011 | Budde | 403/188 |
| 2011/0200278 | A1 * | 8/2011 | Radusin | 384/49 |
| 2011/0309732 | A1 * | 12/2011 | Horil et al. | 312/404 |
| 2012/0061534 | A1 * | 3/2012 | Rehage | 248/214 |
| 2012/0090594 | A1 * | 4/2012 | Rehage et al. | 126/339 |
| 2012/0248955 | A1 * | 10/2012 | Rehage et al. | 312/334.1 |

FOREIGN PATENT DOCUMENTS

| | | | | |
|---|---|---|---|---|
| DE | 10 2007 045 745 | | 4/2009 | |
| EP | 1748257 | A2 * | 1/2007 | F24C 15/16 |
| EP | 1 840 473 | | 10/2007 | |
| WO | WO 2007064786 | A1 * | 6/2007 | |
| WO | 2007/074114 | | 7/2007 | |
| WO | 2007/090738 | | 8/2007 | |
| WO | WO 2007090738 | A1 * | 8/2007 | F24C 15/16 |

* cited by examiner

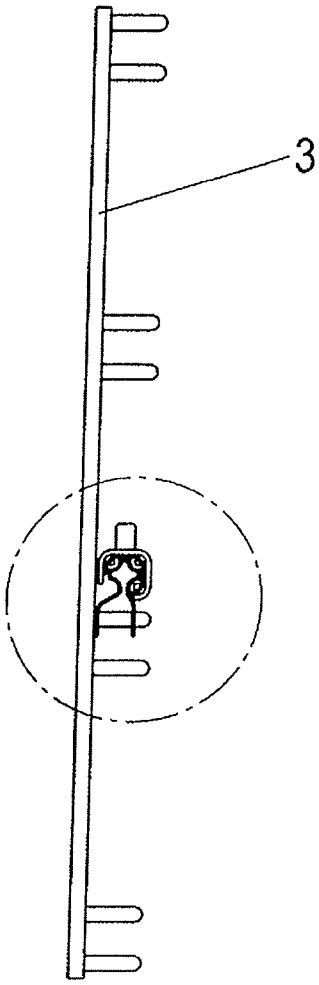
Fig. 3
Fig. 4
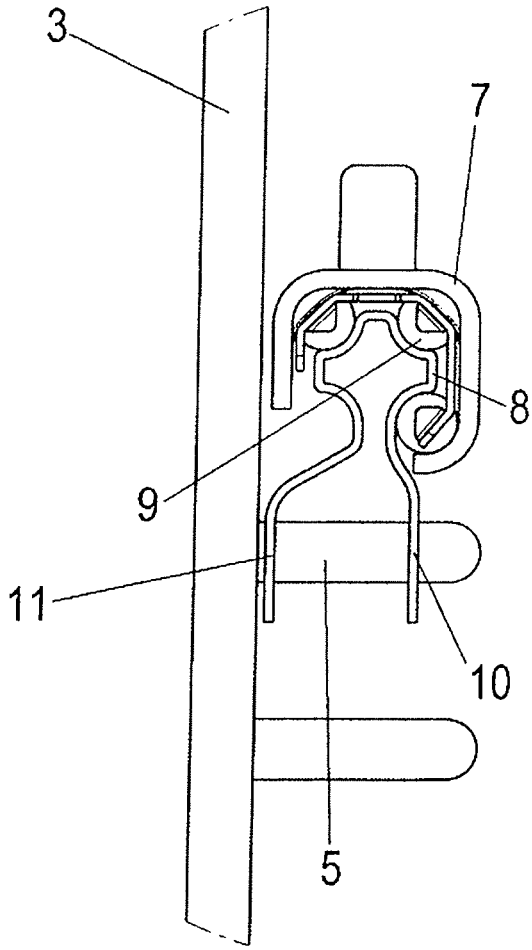

Fig. 17
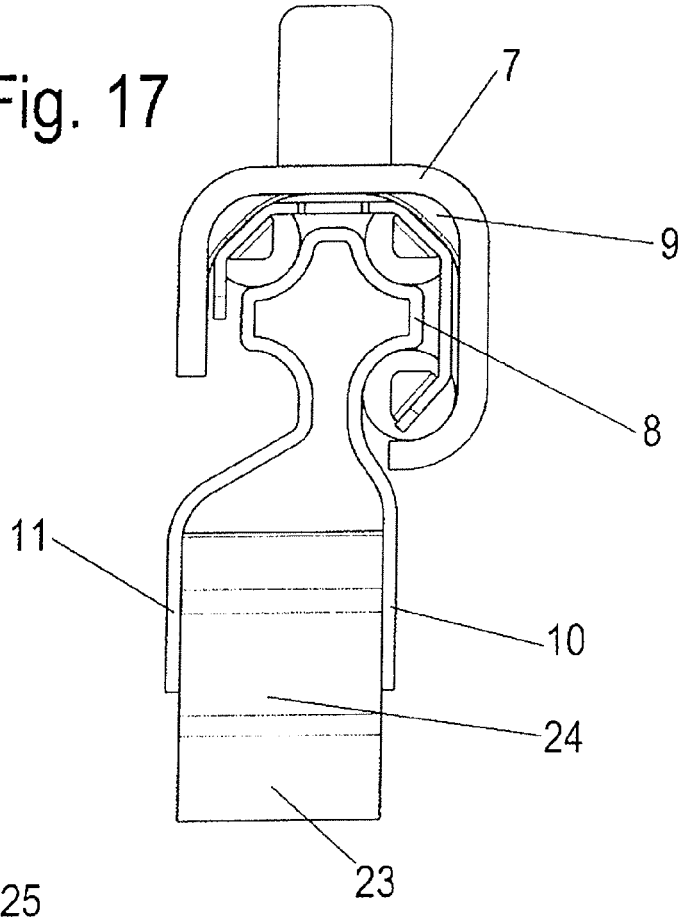
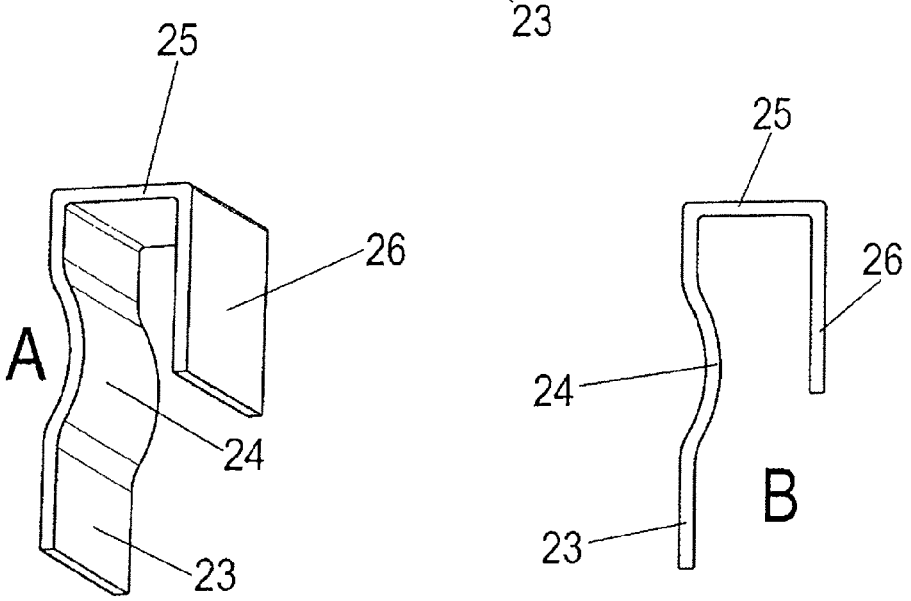
Fig. 18

FASTENING ARRANGEMENT

CROSS-REFERENCE TO RELATED APPLICATION

This application is a national stage of International Application PCT/EP2010/052694, filed Mar. 3, 2010, and claims benefit of and priority to German Patent Application No. 20 2009 003 047.4, filed Mar. 6, 2009, the content of which applications are incorporated by reference herein.

The present disclosure relates to a fastening arrangement for fixing a guide rail of a pull-out guide to a side grid, in, for example, baking ovens. The side grid includes at least one horizontal rod having end sections that are bent at an angle and which end sections are each fixed to a post. The guide rail is fixed to the rod.

WO 2007/074114 discloses a quick fastening device for fastening a guide rail on a rod of a side grid. Two clip-like retaining sections are provided, which are pushed onto the rod. The two retaining sections are fabricated as separate components and welded to the guide rail. The manufacture and fixing of the retaining sections is an additional expenditure during the manufacture of the pull-out guide.

WO 2007/090738 also discloses a pull-out guide in which the guide rail is fixed on the side grid by additional retaining elements.

The present disclosure relates to embodiments of a fastening arrangement for fixing a guide rail of a pull-out guide on a side grid, which fastening arrangements are easy to manufacture and to assemble.

Thus, the present disclosure relates to a fastening arrangement for fixing a guide rail of a pull-out guide to a side grid of an oven. The side grid includes a rod having end sections bent at an angle and each end section is fixed to a post of the side grid and the guide rail is fixed to the rod. The fastening arrangement includes fastening means for fixing the guide rail to the rod and the fastening means is formed integrally with the guide rail.

According to an embodiment of the present disclosure, the guide rail includes integrally formed fastening means for fixing the guide rail to the rod. As a result, the use of additional retaining elements which, in the past, may have been welded to the guide rail, can be dispensed with. The guide rail can thereby be manufactured and mounted in a simple manner.

The guide rail may have least one slot on its underside, into which guide rail a bent end section of the rod is inserted. A slot can be aligned both horizontally, and also vertically or obliquely, where the alignment of the slot predefines the assembly movement. The guide rail may have a rear slot into which a rear bent end section of the rod is inserted and a front slot into which a front bent end section of the rod is inserted. As a result, the guide rail can be loaded in different directions without becoming detached from the side grid. The slots may be aligned at an angle to one another, for example, at right angles, so that a secure hold is ensured. The size of the slots can be configured such that the rod, which may have a round cross-section, is accommodated positively in the slot.

In an embodiment according to the present disclosure, the guide rail can be fixed to the rod by pushing in and pivoting. As a result, a rear end section can initially be accomplished or achieved by pushing into a horizontally aligned slot. The guide rail is then pivoted downwards in order to insert a front bent end section into a front vertical slot. However, other assembly movements are also within the scope of the present disclosure. For example, hooks can be formed integrally with the guide rail so that the guide rail can be suspended on a rod.

Latching, or fastening, means may be provided to fix the guide rail in the mounted position on the rod. This prevents any accidental dismounting of the guide rail. The fastening means may include a bendable web formed integrally with the guide rail, which fastening means is engaged on the rod during assembly. The fastening means may, according to the present disclosure, act both on the rod in the area of the longitudinal extension and also in the area of the bent end section or on the post.

For a stable mounting of the guide rail, the fastening means may include two strip-shaped legs spaced apart from one another, where a first leg abuts against the vertical post and a second leg abuts against the horizontal rod. Any movement of the guide rail perpendicular to the longitudinal extension of the guide rail can thereby be avoided since the guide rail is supported on opposite sides. In addition, a compact structure is obtained since the guide rail is mounted between the rod and the vertical post and does not project further into, for example, a cooking chamber than do the rods.

Other aspects of the present disclosure will become apparent from the following descriptions when considered in conjunction with the accompanying drawings.

BRIEF DESCRIPTION OF THE DRAWINGS

FIGS. 1 to 4 show several views of an embodiment of a fastening arrangement, according to the present disclosure.

FIGS. 12A and 12B show two views of a modified fastening arrangement that is mounted, according to the present disclosure.

FIG. 17 shows a cross-sectional view of the pull-out guide of FIG. 16.

FIGS. 18A and 18B show two views of a fastening means of the pull-out guide of FIG. 16, according to the present disclosure.

DETAILED DESCRIPTION

Figure 1:
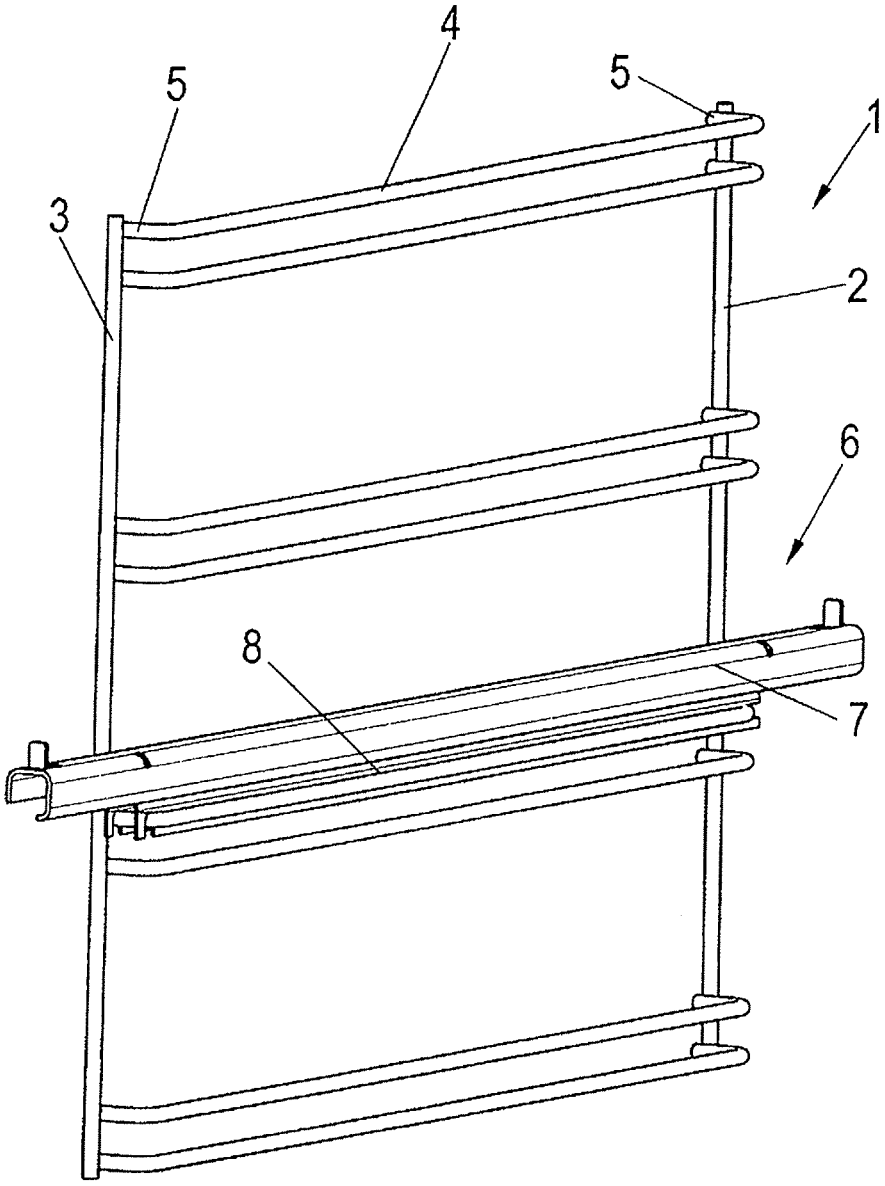
Figure 2:
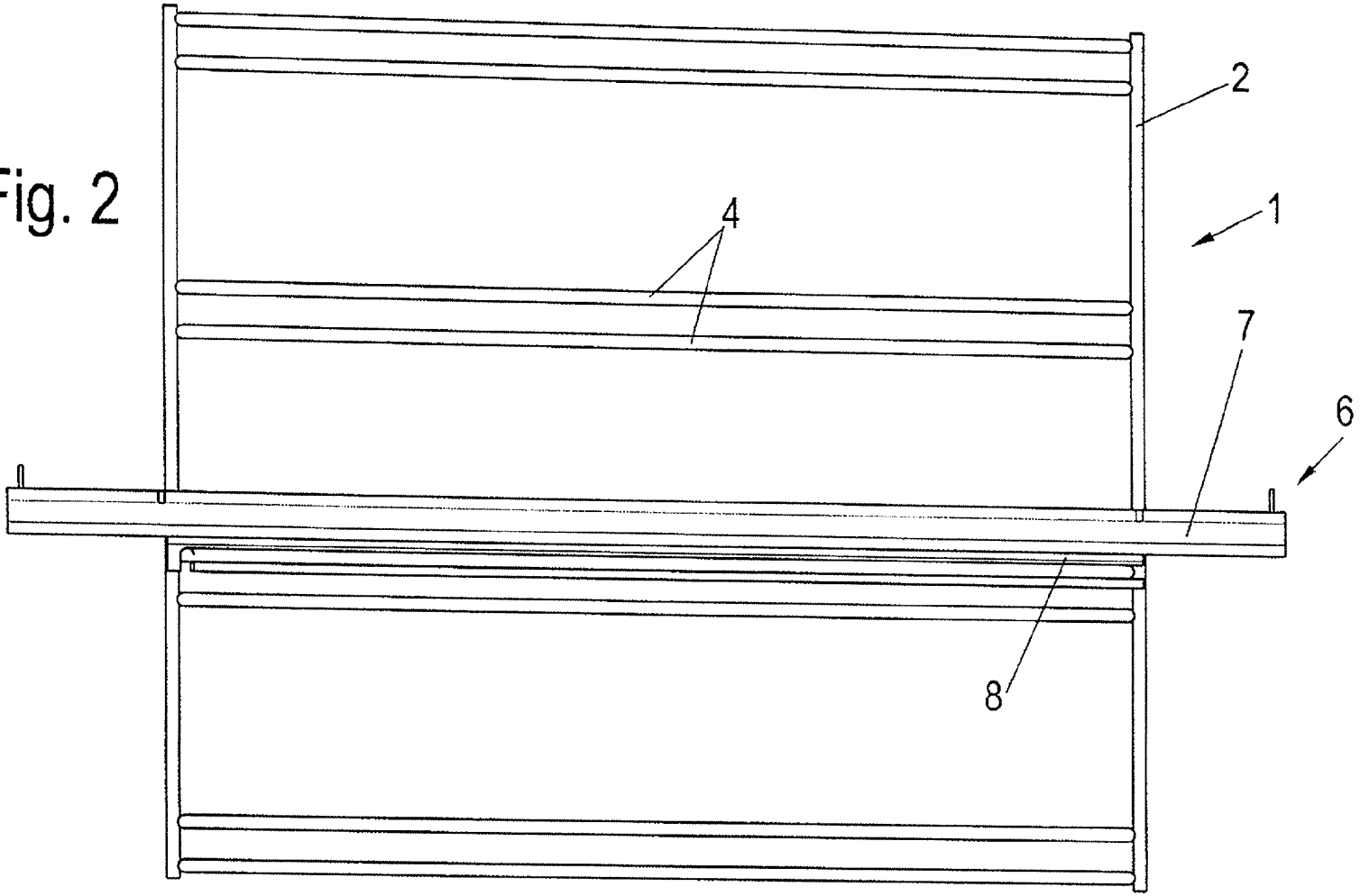
Figure 5:
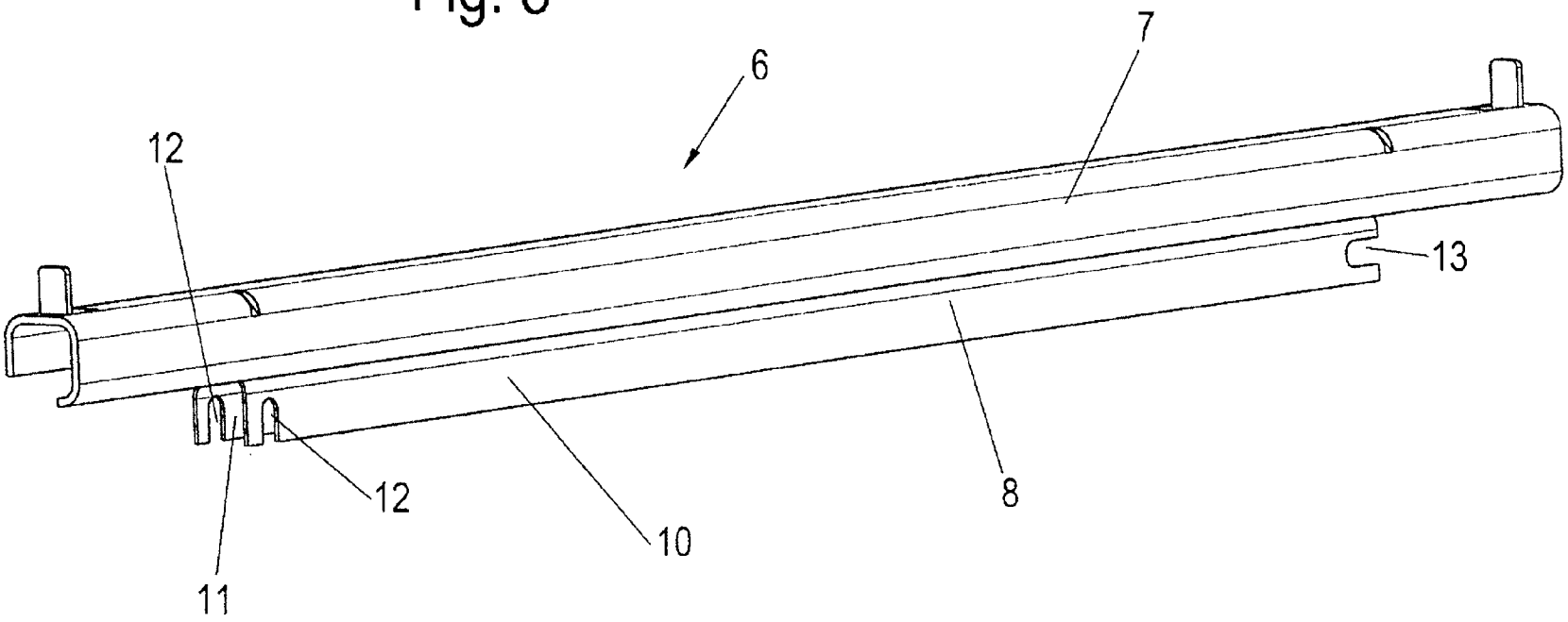
FIG. 5 shows a perspective view of the pull-out guide of the fastening arrangement of FIG. 1.
Figure 6:
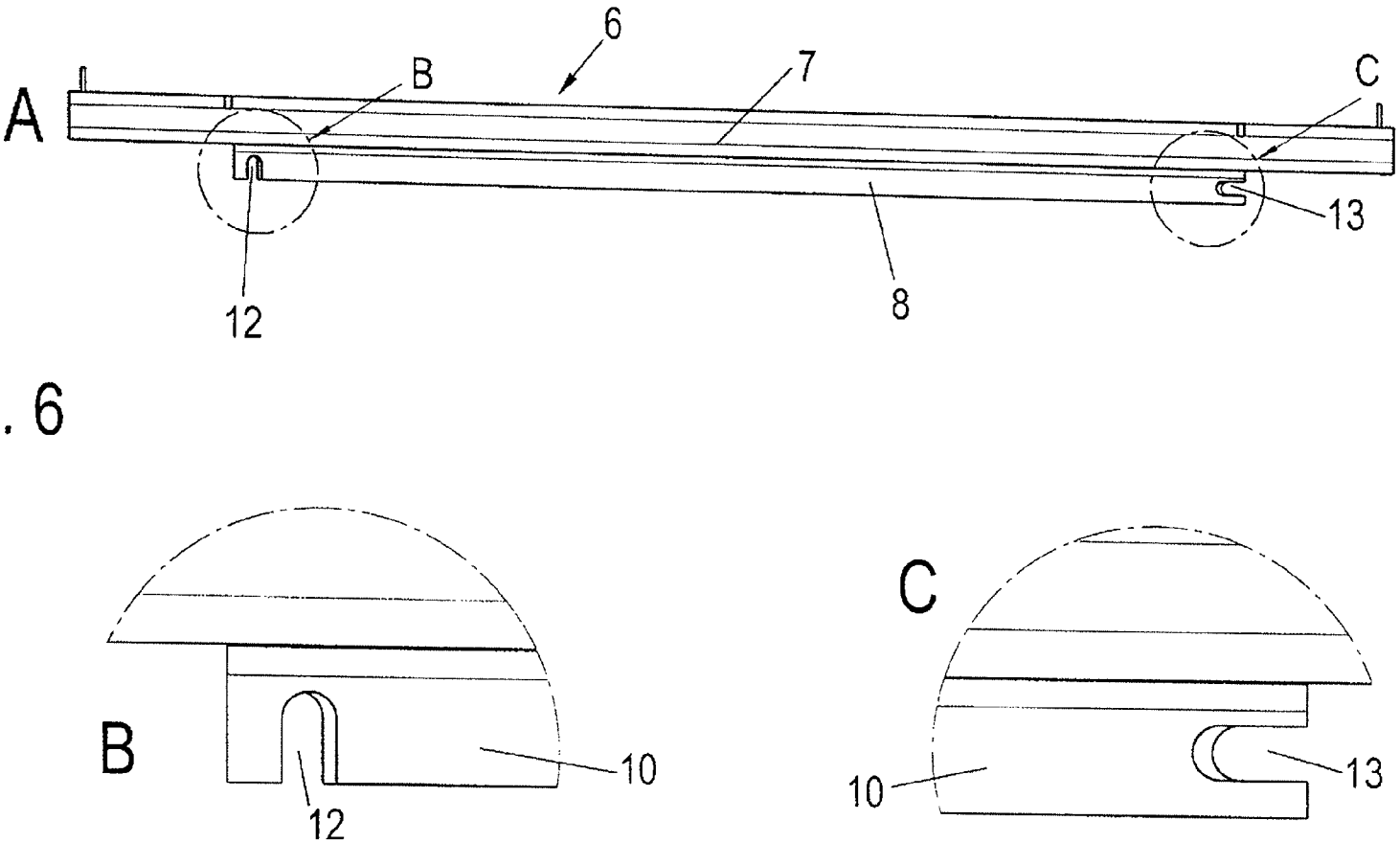
FIGS. 6A to 6C show several views of the pull-out guide of the fastening arrangement of FIG. 1.

A fastening arrangement includes a side grid 1 in which a first vertical post 2 and a second vertical post 3 are interconnected via a plurality of horizontal rods 4. The rods 4 are provided on opposite sides with an end section 5 bent at a right angle, each end section 5 being fixed to post 2 or 3. Such side grids 1 are mounted, for example, on side walls of, for example, a baking oven. It is within the scope of the present disclosure that other applications, for example, in other kitchen appliances or furniture, are possible.

In order to mount items movable on the side grid 1, for example, food trays or baking trays, for example, a pull-out guide 6 is mounted on at least one horizontal rod 4. The pull-out guide 6 includes a guide rail 8 and at least one movably mounted running rail 7. In order to achieve a full or over pull-out, a pull-out extending central rail can, within the scope of the present disclosure, be disposed between guide rail 8 and running rail 7.

As shown in FIGS. 3 and 4, the guide rail 8 has an upper head section on which three bent running tracks for spherical rolling bodies 9 are formed. The running rail 7 is movably mounted on the guide rail 8 via the rolling bodies 9. On the downwardly directed side, the guide rail 8 further includes two spaced-apart legs 10 and 11, which legs 10, 11 are mounted on bent end section 5 of rod 4. A first leg 11 rests against post 2 or 3 and second leg 10 is positioned adjacent to rod 4 in the central region so that a movement of the guide rail 8 in the direction of the bent end sections 5 is delimited by the bent end sections 5, the rod 4 and the posts 2 and 3.

A horizontal slot 13 having the shape of an elongate hole that is open towards the back is formed on the guide rail 8 in the rear area for fixing on the side grid 1. In the front area, a vertical slot 12, that is also configured as an elongate hole and is open towards the bottom, is formed on the guide rail 8. The slots 12 and 13 extend through both legs 10 and 11 of the guide rail 8. The slots 12 and 13 are, thereby, configured such that the bent end sections 5 of rod 4 can be inserted substantially positively in the slots 12 and 13. For assembly, a rear bent end section 5 is initially inserted into the slot 13 by pushing the rail 8 onto the end section 5. The guide rail 8 is pivoted around the end section 5 in the slot 13 so that a front end section 5 is inserted in the vertical slot 12. The guide rail 8 is secured in this way against release from the side grid 1, except when the pull-out guide 6 is raised in the front area.

Figure 7:
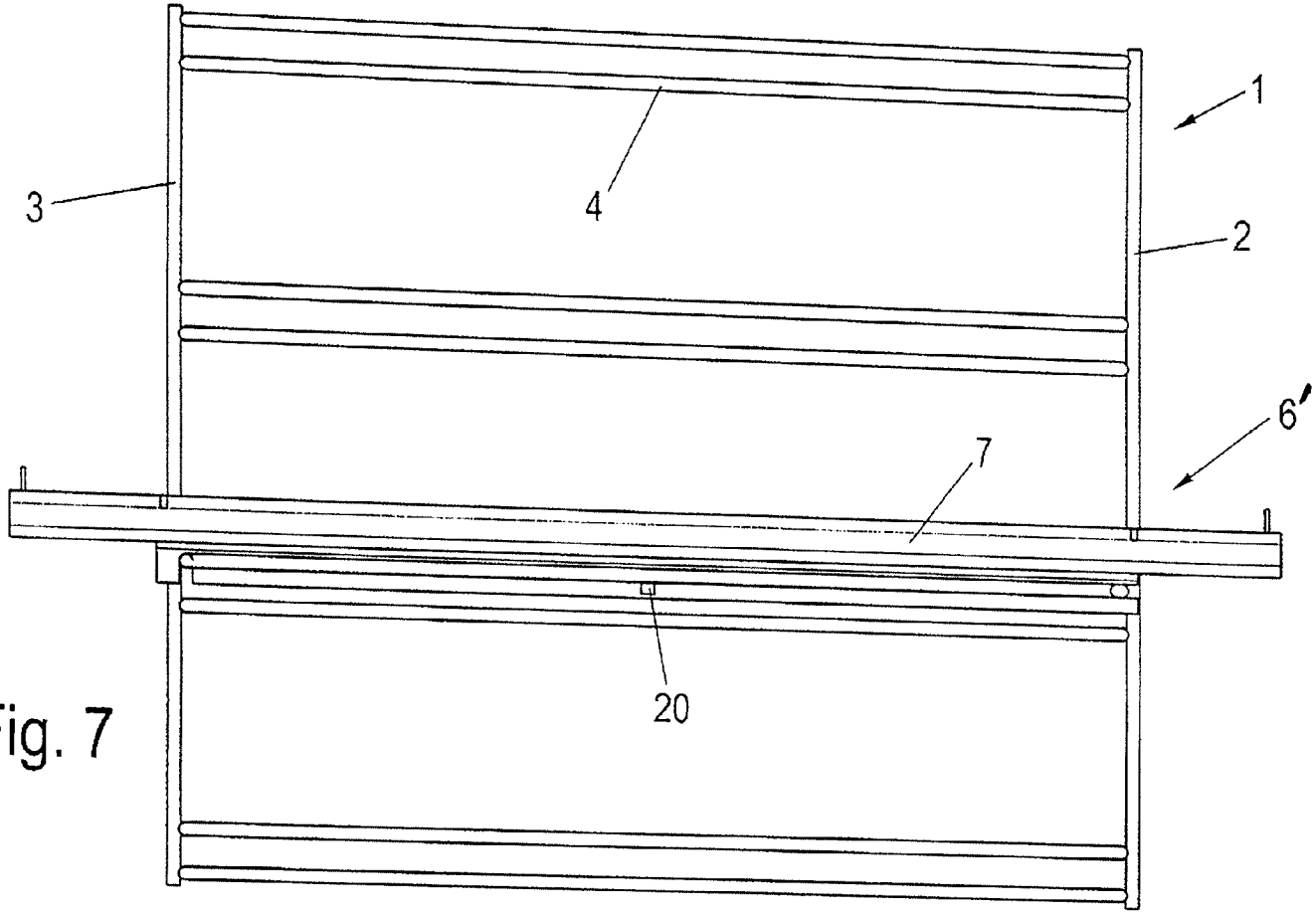
FIG. 7 shows a view of another embodiment of a fastening arrangement, according to the present disclosure.
Figure 8:
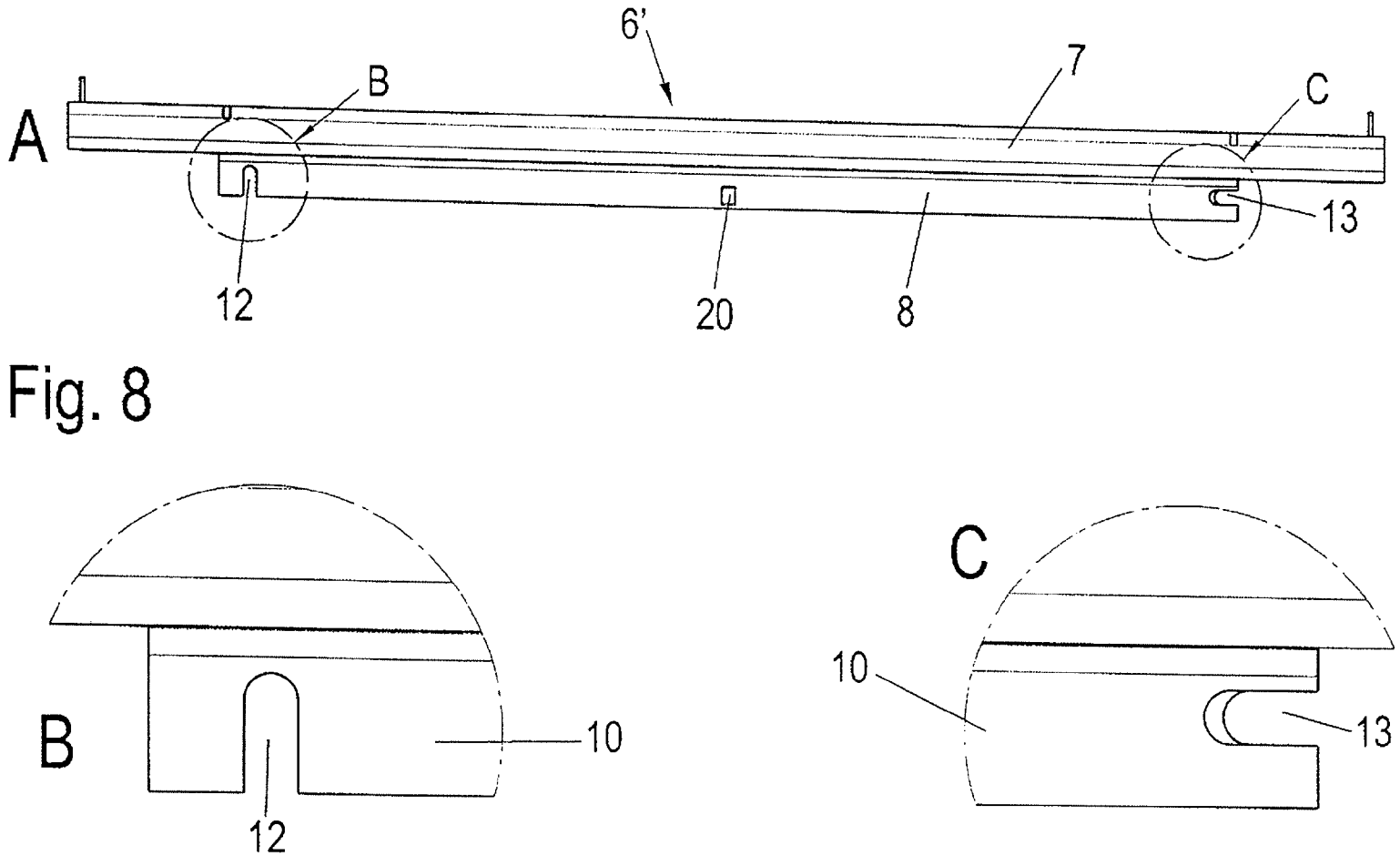
FIGS. 8A to 8C show several views of the pull-out guide of the fastening arrangement of FIG. 7.
Figure 9:
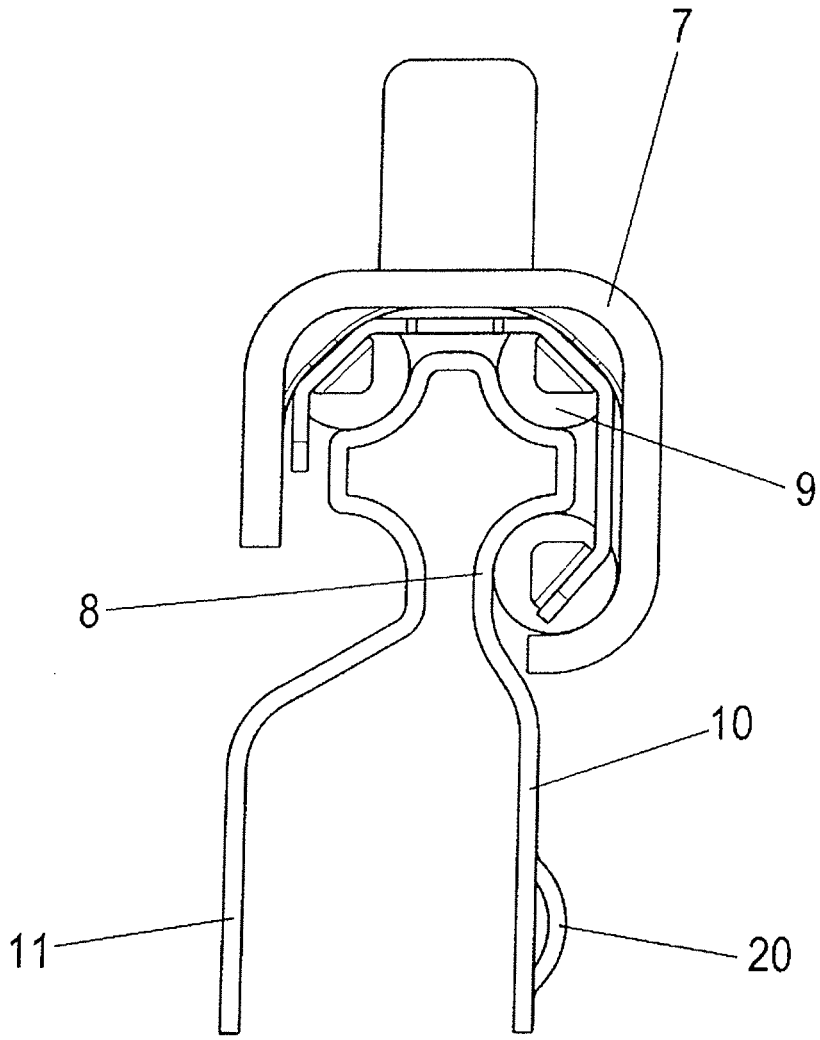
FIGS. 9 to 11 show several views of the pull-out guide of the fastening arrangement of FIG. 7.
Figure 10:
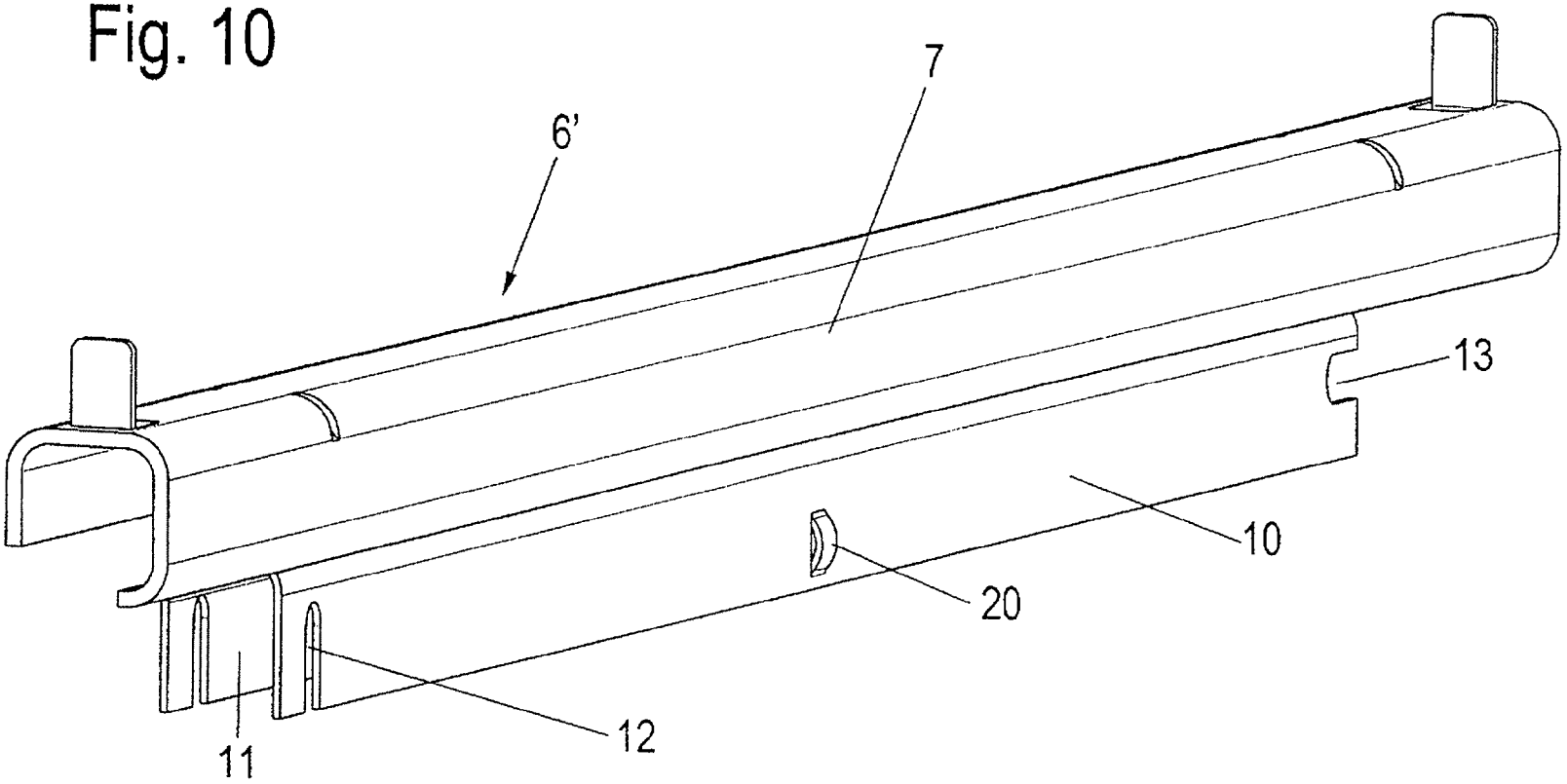
Figure 11:
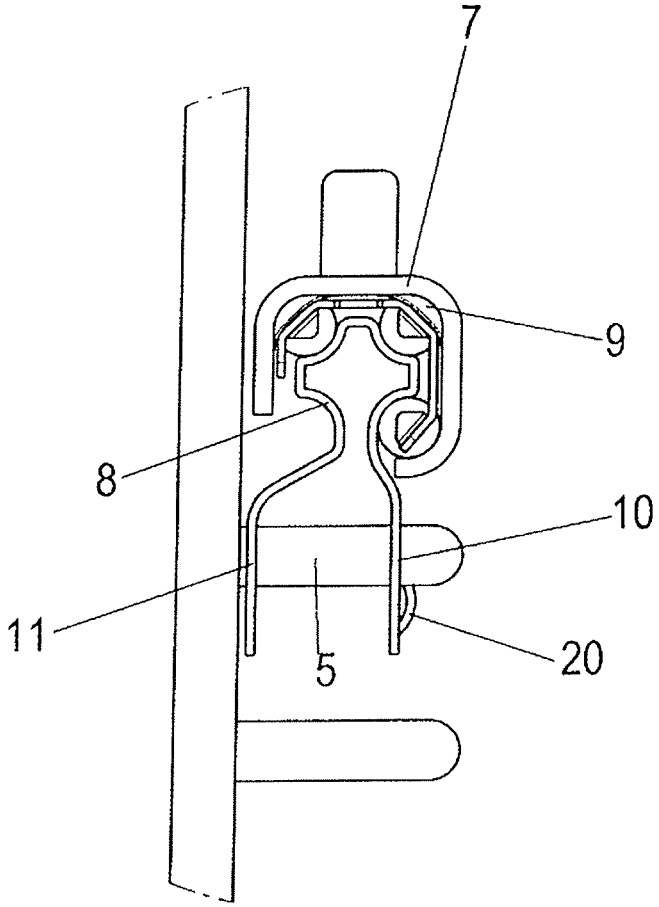

FIG. 7 shows another embodiment of a pull-out guide 6' and a side grid 1. An additional securing against lifting of the pull-out guide 6' in the mounted position is provided.

FIGS. 8A to 8C and FIGS. 9, 10 and 11 show the pull-out guide 6'. Pull out guide 6' includes a guide rail 8, as in the preceding embodiment, and includes two legs 10 and 11 on which a horizontal slot 13 is made in the rear area and a vertical slot 12 is made in the front area. Furthermore, a fastening means, in the form of a bendable web 20, is formed on the guide rail 8 on leg 10, which web 20 can be engaged on rod 4 in a central region. The bendable web 20 projects slightly from the leg 10 and can be bent slightly together with the leg 10 when pushing the guide rail 8 onto the side grid 1 and form an undercut with rod 4. The bendable web 20 thus fixes the guide rail 8 on the side grid 1 and prevents undesirable lifting of the pull-out guide 6'.

The pull-out guide 6' is assembled by pushing the guide rail 8 onto a rear bent end section 5 in such a manner that the rear bent end section 5 is inserted in the slot 13. The guide rail 8 is then pivoted downwards so that a front bent end section 5 engages in the vertical slot 12. The leg 10 is thereby pressed inwards and the bendable web 20 grips below rod 4 in the central region.

The bendable web 20 can thereby be configured as latching means so that, in the mounted position, the spaced-apart legs 10 and 11 of the guide rail 8 are fixed in a clamping manner between rod 4 and posts 2 and 3. Thus, during a movement of the running rail 7, the guide rail 8 is securely fixed and rattling noises are avoided. In addition, by gripping under rod 4, the bendable web 20 forms a securing means against a lifting of the pull-out guide 6'.

Figures 12, 13:
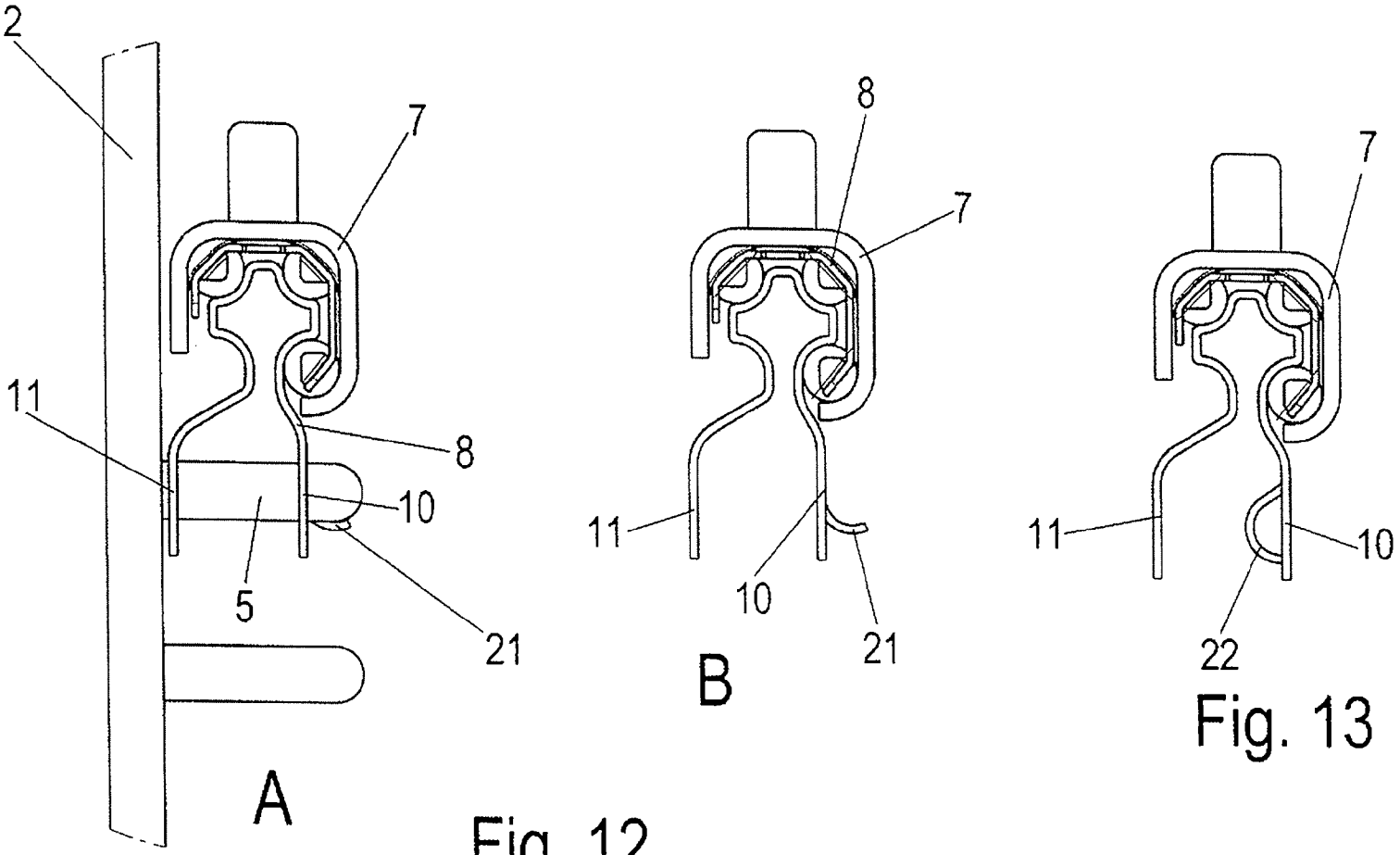
FIGS. 13 and 14 show two views of a pull-out guide for another embodiment of a fastening arrangement, as shown in FIG. 12 prior to mounting, in accordance with the present disclosure.

FIGS. 12A and 12B show a modified embodiment, according to the present disclosure, of a fastening arrangement in which a guide rail 8 of a pull-out guide 6" is fixed on a side grid 1. The guide rail 8 includes two spaced-apart legs 10 and 11. An outwardly bent web 21 is formed on the leg 10 or 11 which is located at a distance from the post 2. The outwardly bent web 21 grips under the rod 4 on which the guide rail 8 is fixed and forms a securing means against any unintentional lifting of the guide rail 8. For assembly, after pushing on the guide rail 8, the bent web 21 is bent outwards or even stamped by an assembly tool or manually from the position shown in FIGS. 13 and 14 in order to achieve the position shown in FIGS. 12 and 15. After assembly, the bent web 21 encompasses the rod 4 and thus forms a securing means from lifting of the pull-out guide 6" and a fixing of the pull-out guide 6" on the side grid 1.

Figure 14:
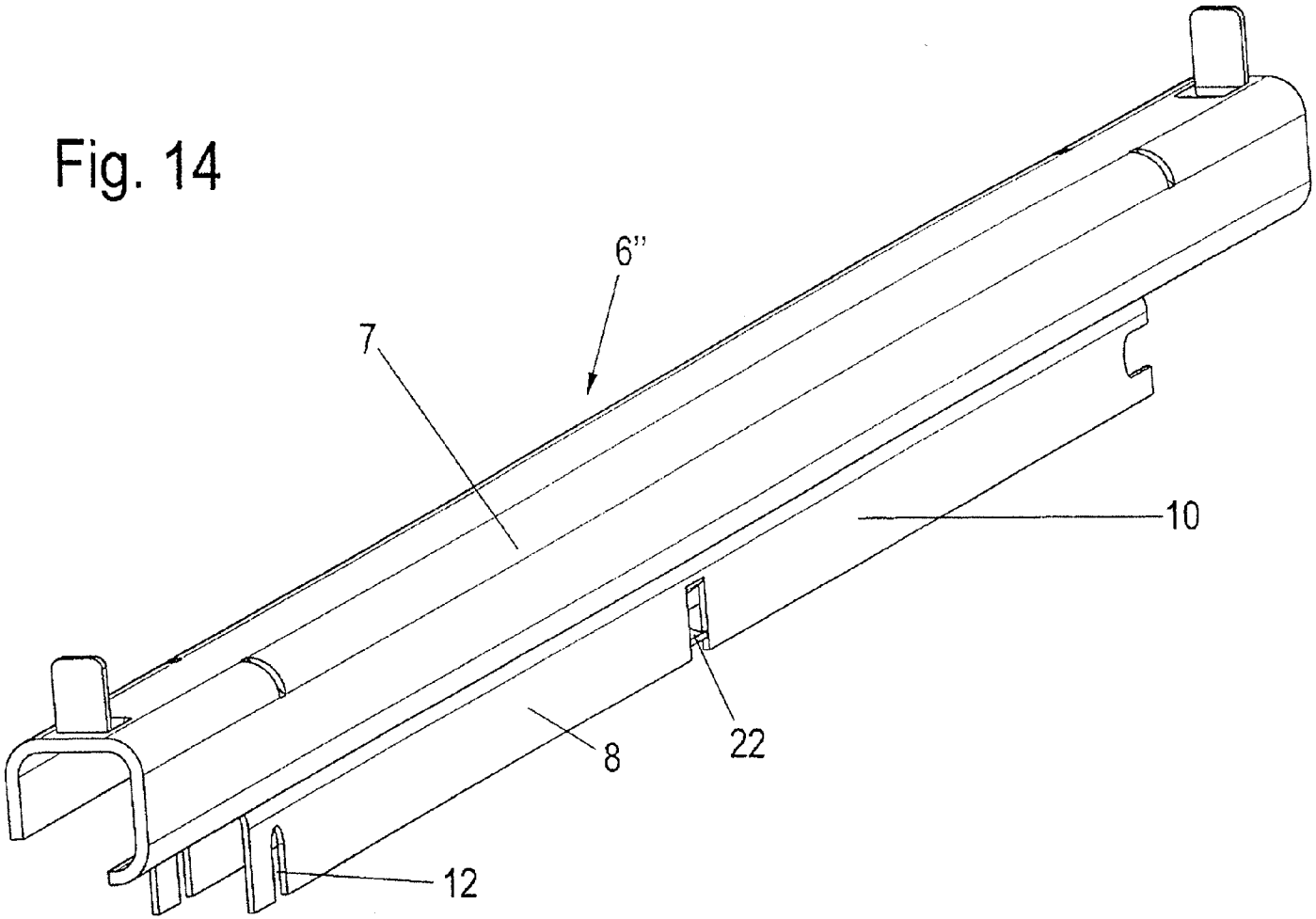
Figure 15:
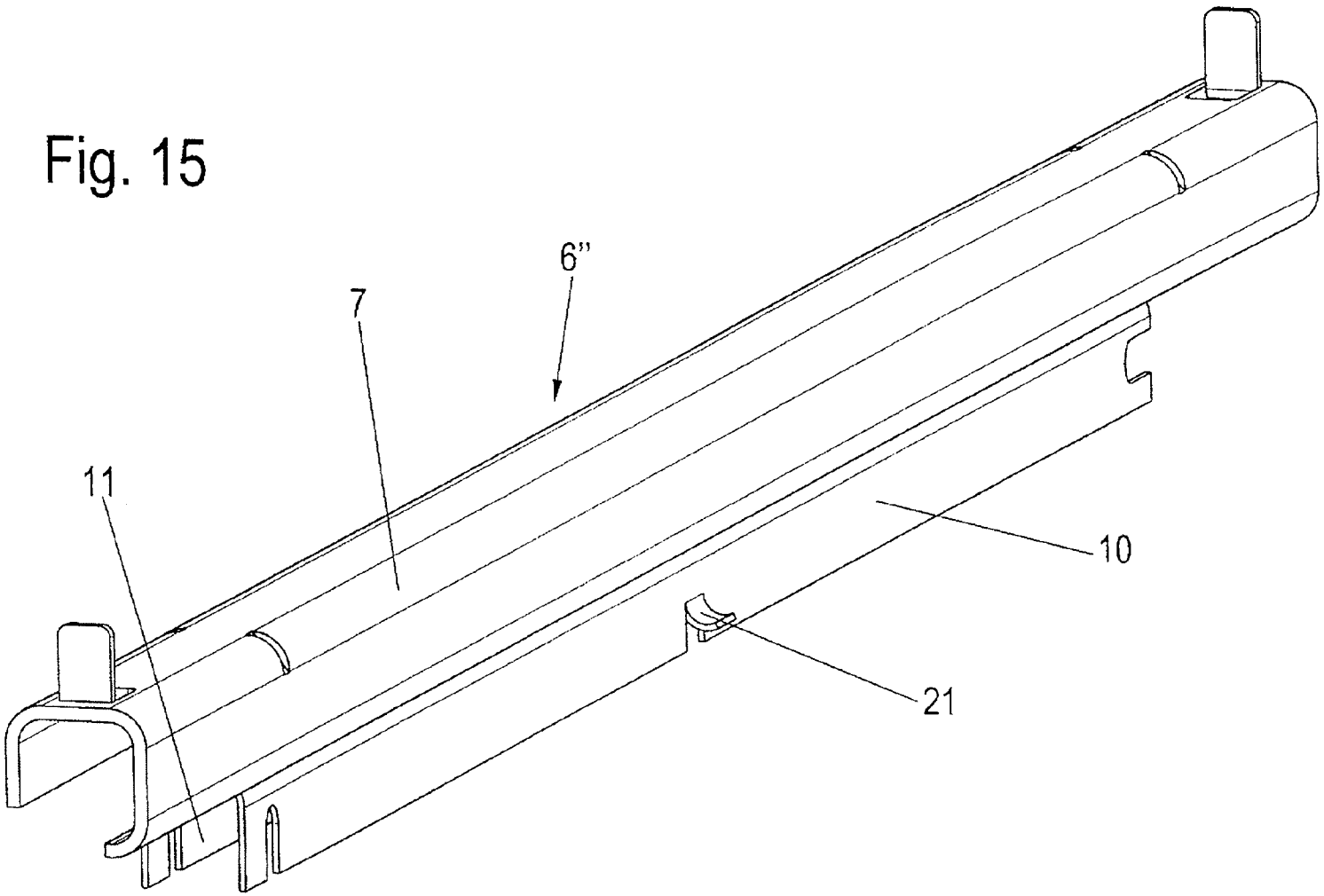
FIG. 15 shows a perspective view of the pull-out guide of the fastening arrangement of FIG. 12 that is mounted.

FIGS. 13 and 14 show an embodiment, according to the present disclosure, of a guide rail 8 according to FIGS. 12 and 15 before assembly, which guide rail 8 can be fixed on a side grid 1. The fastening means is formed on the leg 10 in the form of an inwardly bent web 22.

FIG. 15 shows the pull-out guide 6" from FIG. 12 in the mounted position but without side grid 1.

Figure 16:
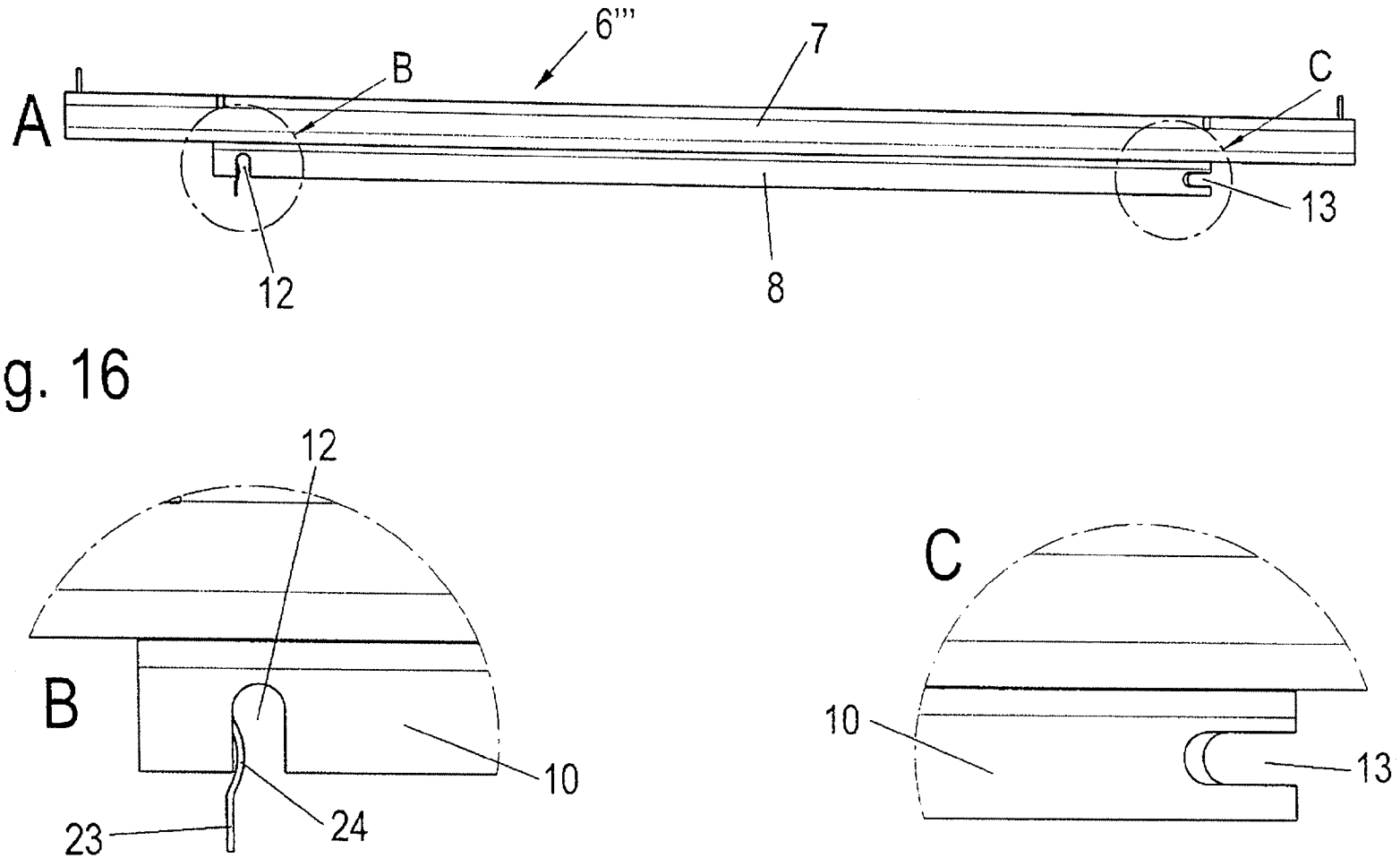
FIGS. 16A to 16C shows several views of a pull-out guide of another embodiment of a fastening arrangement, according to the present disclosure.

FIGS. 16 and 17 show another embodiment of a pull-out guide 6''' in which a guide rail 8 is configured for engagement on a side grid 1. In the rear area, the guide rail 8 again has a horizontally running slot 13 which is made in both legs 10 and 11. A vertical slot 12 is formed in the front area, on which fastening means 23 is configured in the form of a downwardly bent web 23. On the side facing the interior of the slot 12, the web 23 has a dome 24 so that a bent end section 5 inserted in the slot 12 ensures that the web 23 is bent away until the bent end section 5 has reached the end of the slot 12 and the web 23 partially grips the bent end section 5 above dome 24.

The bent web 23 can, according to the present disclosure, be formed integrally with the guide rail 8.

FIGS. 18A and 18B show a clip which forms the bendable web 23. The clip includes a base section 25 which is fixed on a wall of the guide rail 8. The fixing can be made, for example, in a firmly bonded manner. The U-shaped clip encompasses the bendable web 23 with the inwardly directed dome 24, where a leg 26 is provided as a counter-bearing. For assembly of the clip, bent end section 5 is inserted in the receptacle, where the leg 26 engages the bent end section 5. A fastening means, in the form of the slots 12 and 13 (see, for example, FIGS. 16A and 19A), are thus formed integrally with the guide rail 8, whereas a fastening means may be configured for securing the guide rail 8 as a separate component in the form of the U-shaped clip.

Figure 19A:
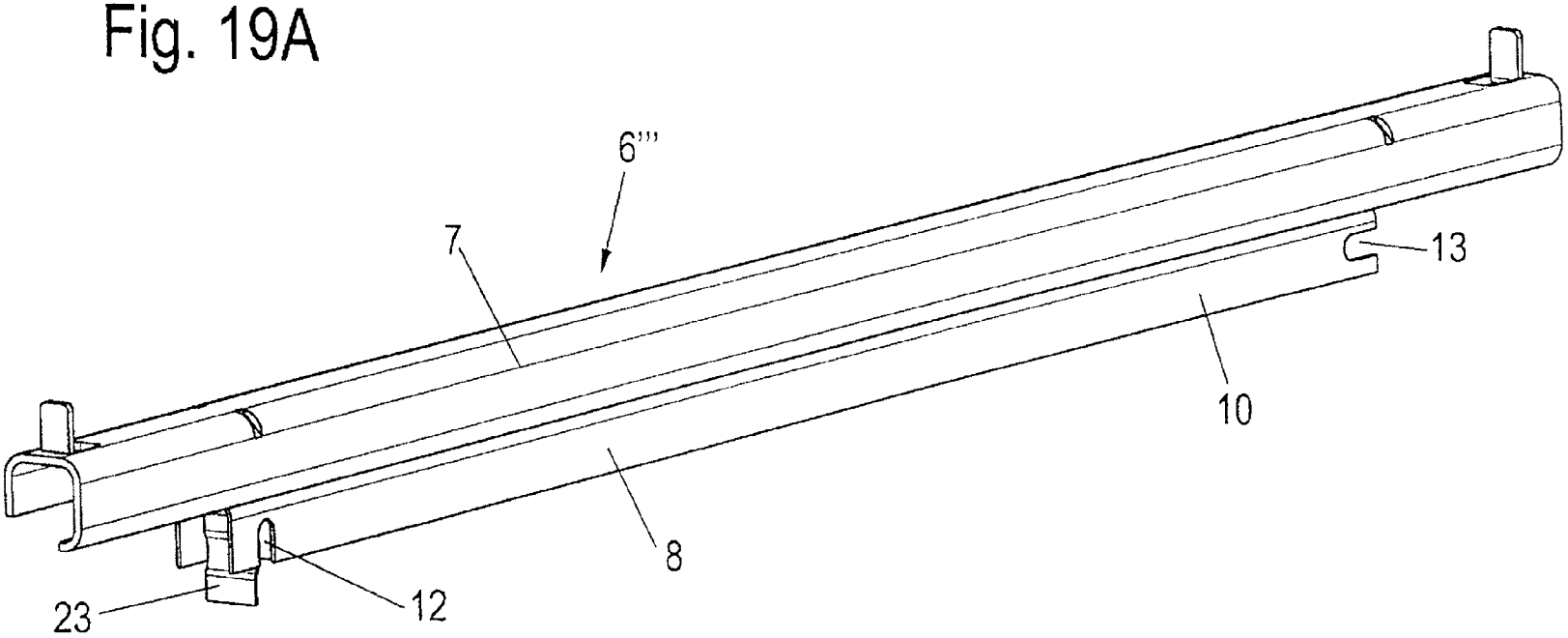
FIGS. 19A and 19B show two views of the pull-out guide of FIG. 16.
Figure 19B:
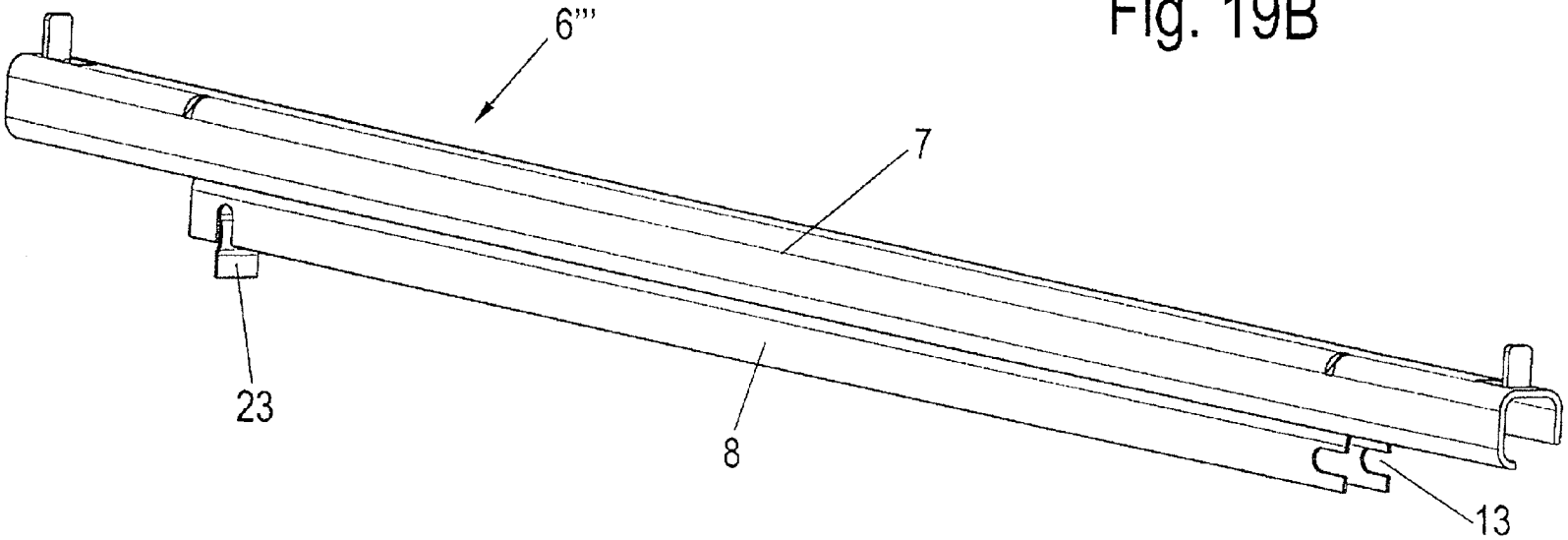
Figure 20:
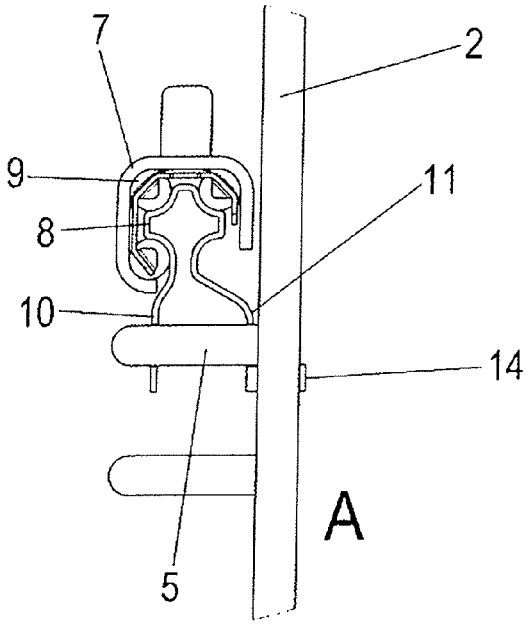
FIGS. 20A to 20C show several views of a mounted pull-out guide of another embodiment of a fastening arrangement, according to the present disclosure.
Figure 20:
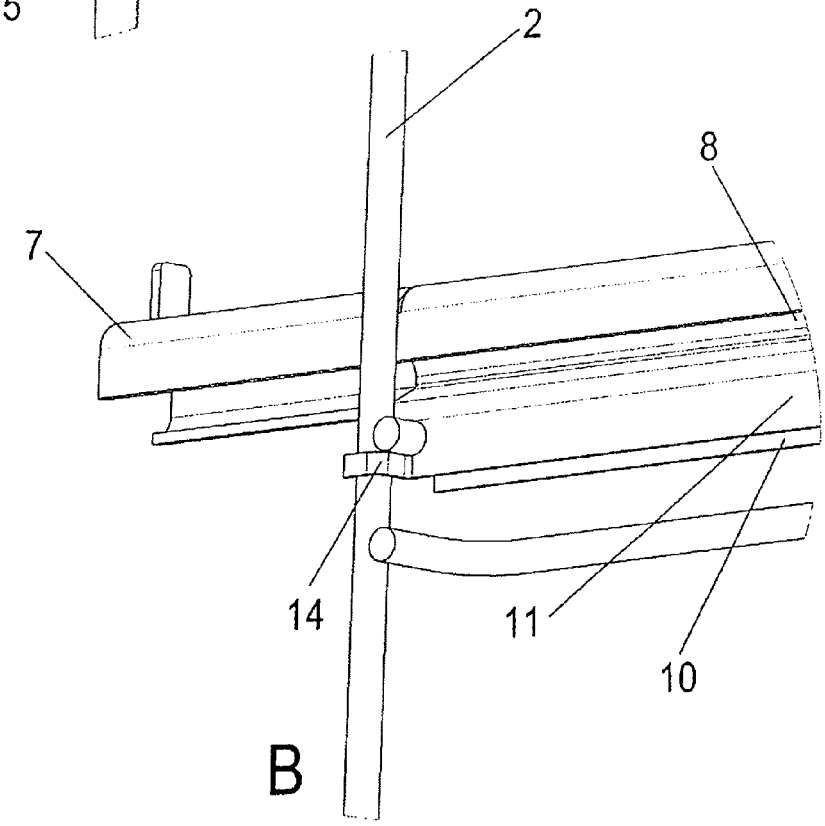
Figure 20C:
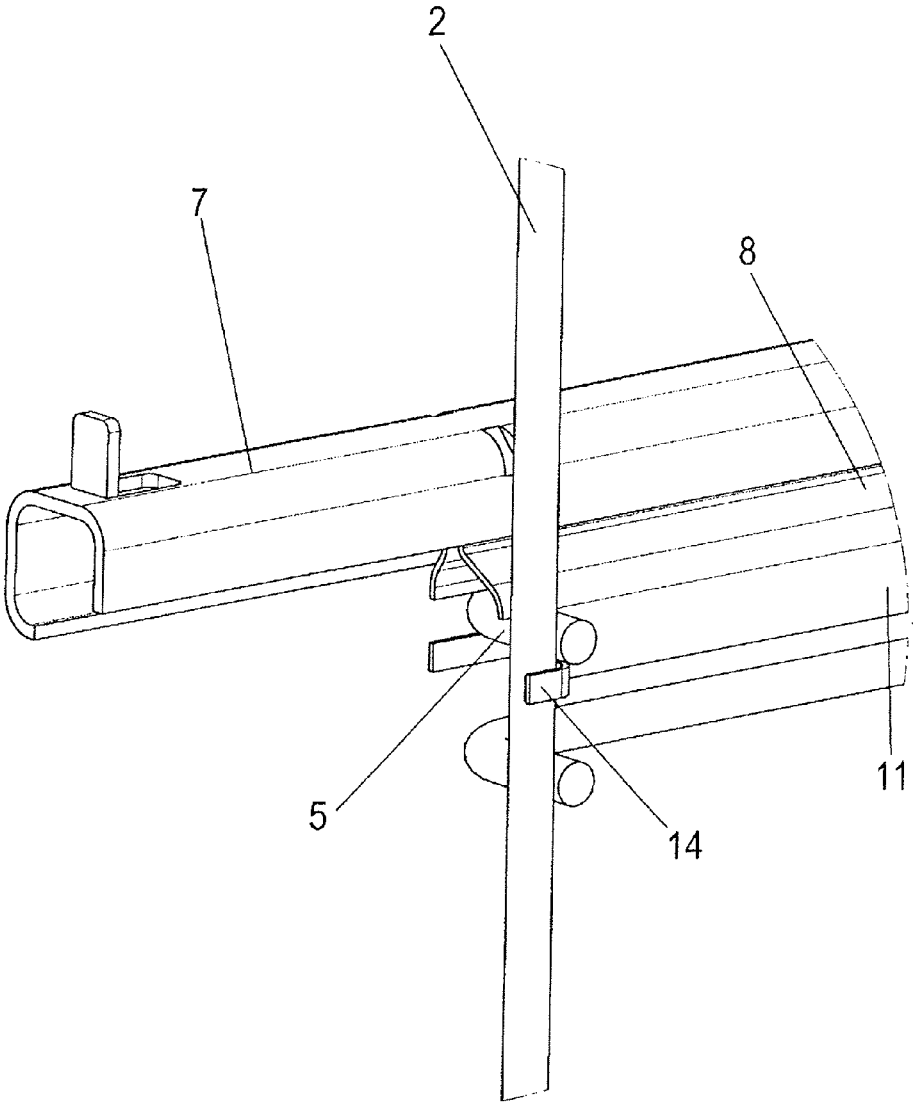
Figure 21:
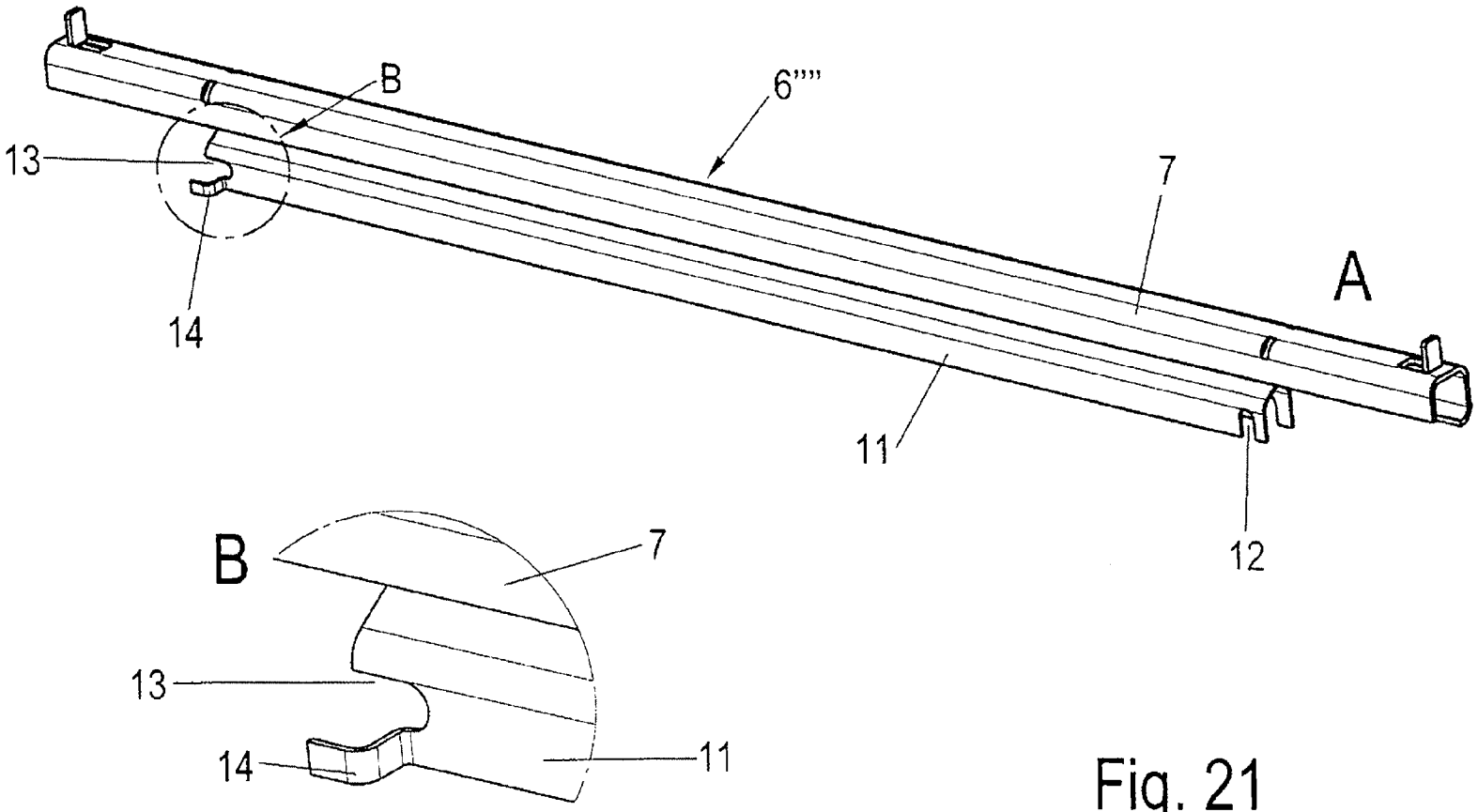
FIGS. 21A and 21B show two views of a pull-out guide of an embodiment according to the present disclosure and according to FIGS. 20A to 20C.

FIGS. 19A and B show the pull-out guide 6''' from FIG. 16 in the position where it is not yet mounted. The leg 23 of the U-shaped clip projects downwards beyond the guide rail 8. It is within the scope of the present disclosure to have an embodiment in which the leg 23 of the U-shaped clip does not project downwards beyond the guide rail 8.

FIGS. 20A-C and 21A-C show another embodiment of a fastening arrangement, according to the present disclosure. Such a pull-out guide 6'''' includes a latching hook 14 on guide rail 8 in the rear area of the leg 11, which hook 14 grips behind the first vertical post 2. Slippage of the pull-out guide 6'''' in the direction of the rod 4 is thereby prevented. Possible tolerances from the manufacturing process for the side grid 1 therefore have no influence on the fixing of the guide rail 8 adjacent to the posts 2 and 3.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A fastening arrangement for fixing a guide rail of a pull-out guide to a side grid of an oven, the side grid including a horizontal rod having end sections bent at an angle and each end section being fixed to a post of the side grid and the guide rail being fixed to the rod, the fastening arrangement comprising:

a guide rail including a plurality of tracks, each track formed to accommodate rolling bodies; and a running rail movably mounted on the guide rail via the rolling bodies;

the guide rail further including first and second substantially parallel, spaced-apart, strip-shaped legs integrally formed with and extending from the plurality of tracks;

wherein each of the first and second legs defines a front slot and a rear slot, each of the rear slots configured to receive a rear one of the bent end sections and each of the front slots configured to receive a front one of the bent end sections; and wherein the rear slot is oriented in a first direction and the front slot is oriented in a second direction different from the first direction, said first direction substantially perpendicular to said second direction.

2. The fastening arrangement according to claim 1, wherein the guide rail is configured to be fixed on the rod by pushing each of the rear slots onto the rear one of the bent end sections and pivoting each of the front slots onto the front one of the bent end sections.

3. The fastening arrangement according to claim 1, wherein the front and rear slots fix and secure the guide rail in a mounted position on the rod.

4. The fastening arrangement according to claim 1, wherein the guide rail includes an integrally formed bendable web.

5. The fastening arrangement according to claim 1, wherein a first of the two legs abuts against a vertical post of the side grid and a second of the two legs abuts against a central section of the rod.

6. The fastening arrangement according to claim 1, wherein the guide rail is made from one of a stamped and bent metal sheet and a profiled metal sheet.

7. The fastening arrangement according to claim 1, wherein the guide rail defines an interior portion and an exterior portion, and the tracks are disposed on the exterior portion.

* * * * *